US005896582A

United States Patent [19]

Baacke et al.

[11] Patent Number: 5,896,582

[45] Date of Patent: Apr. 27, 1999

[54] OUTERWEAR GARMENT HAVING A WATERPROOF SEAT

[75] Inventors: Dennis R. Baacke, Irma; Sharon A. Flashinski, Wausau, both of Wis.

[73] Assignee: Fox Point Sportswear, Inc., Merrill, Wis.

[21] Appl. No.: 09/009,513

[22] Filed: Jan. 20, 1998

[51] Int. Cl.[6] ..... A41D 13/02

[52] U.S. Cl. ..... 2/79; 2/227; 2/82

[58] Field of Search ..... 2/79, 227, 228, 2/46, 51, 69, 75, 80, 82, 238, 243.1

[56] References Cited

U.S. PATENT DOCUMENTS

| | | |
|---|---|---|
| Re. 29,034 | 11/1976 | Fregeolle . |
| Re. 33,966 | 6/1992 | Robison . |
| 4,241,460 | 12/1980 | Tolbert . |
| 4,371,989 | 2/1983 | Polsky . |
| 4,488,317 | 12/1984 | Polsky . |
| 4,682,479 | 7/1987 | Pernick . |
| 4,785,480 | 11/1988 | Polsky . |
| 4,894,869 | 1/1990 | Boll . |
| 4,993,077 | 2/1991 | Robison . |
| 4,999,845 | 3/1991 | Jenks, Jr. et al. . |
| 5,068,920 | 12/1991 | Bray . |
| 5,081,718 | 1/1992 | Carman et al. . |
| 5,155,867 | 10/1992 | Norvell . |

*Primary Examiner*—Gloria M. Hale
*Attorney, Agent, or Firm*—Andrus,Sceales,Starke & Sawall

[57] ABSTRACT

An outerwear garment such as pants or coveralls has a waterproof seamless seat insert. The insert made of waterproof fabric and is attached to the garment to cover at least the seat portion and the adjacent rear leg portions of the garment. The waterproof insert is attached to the garment inside of the outer layer, and if the garment has an inner liner, preferably between the outer layer and the inner liner. The seamless seat waterproof insert is attached to the garment along its periphery so that the seamless seat is substantially free of the seat portion of the outer layer. The waterproof seamless seat insert eliminates the need to waterproof a back rise seam in the insert. The insert preferably continues under the crotch and towards the waist to provide a seamless crotch as well. The insert is preferably made of a relatively lightweight, stretch material so that the insert does not compromise the fit of the garment that is defined by the other textile layers of the garment.

18 Claims, 4 Drawing Sheets

FIG. 5A
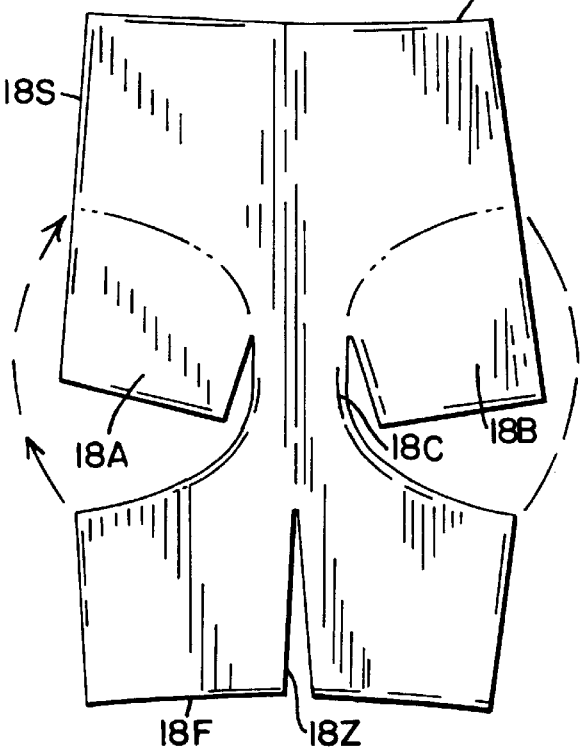
FIG. 5B
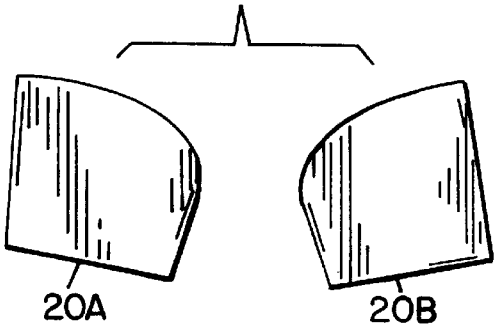
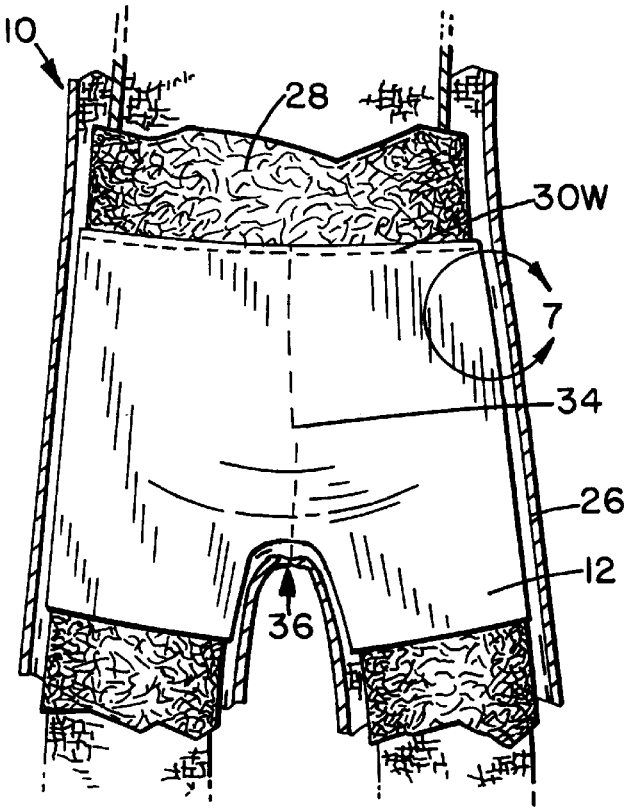
FIG. 6
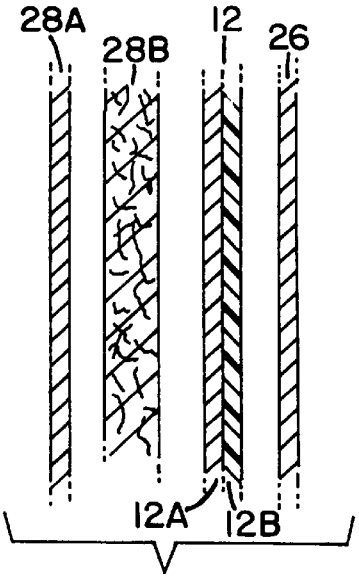
FIG. 7

FIG. 12
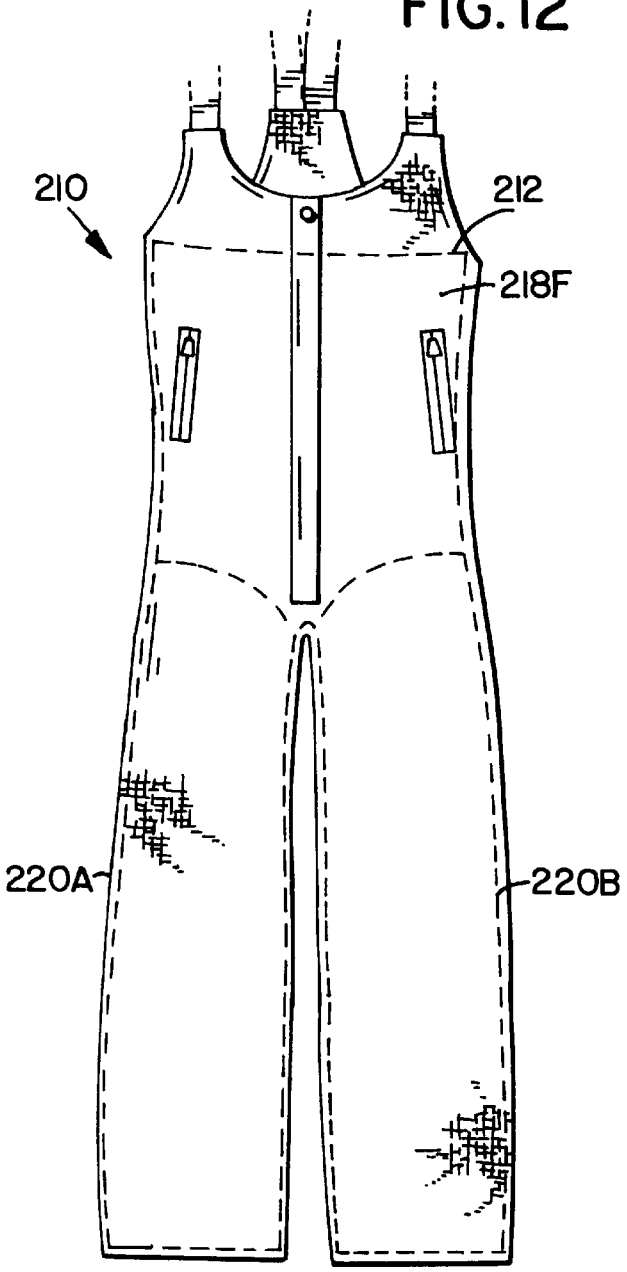
FIG. 13
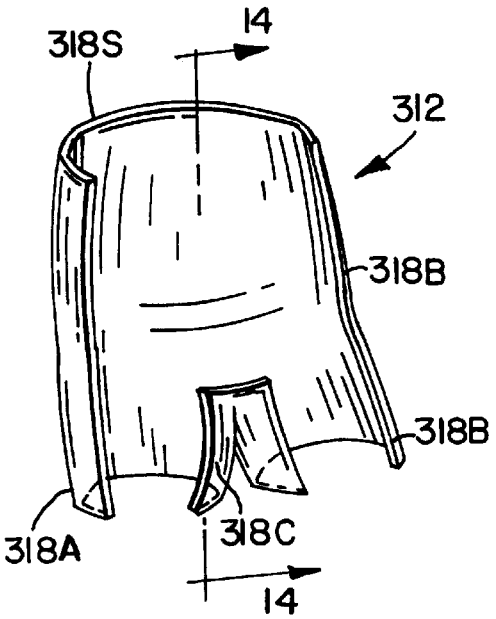
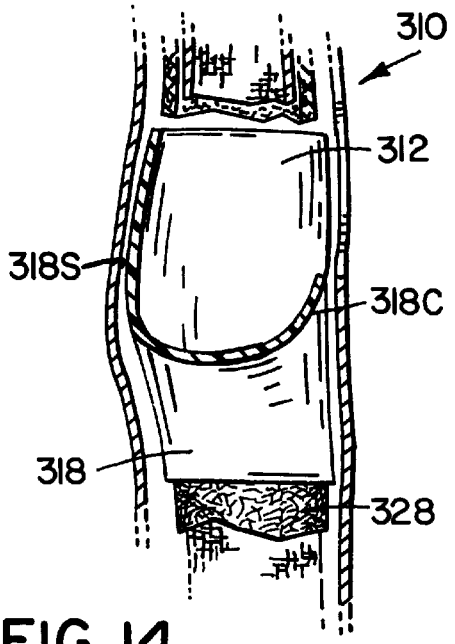
FIG. 14

OUTERWEAR GARMENT HAVING A WATERPROOF SEAT

FIELD OF THE INVENTION

The invention relates to outerwear garments, and in particular to garments normally used during cold and/or wet weather activities such as riding snowmobiles, all-terrain vehicles, trail bikes, cross-country and downhill skiing, ice fishing, hunting, fishing, and similar activities conducted in cold and/or wet weather. The invention provides a unique manner of waterproofing the seat in such outerwear garments which is effective, durable, and practical to manufacture.

BACKGROUND OF THE INVENTION

Most trousers and similar garments such as coveralls are constructed using at least four panels of fabric which cover the legs and torso. The four panels are secured together by sewn seams, namely: a continuous inseam, outseams, a front rise seam and a back rise seam. The continuous inseam, the front rise seam and the back rise seam all intersect at the crotch of the garment. The back rise seam extends from the crotch and passes through the seat portion towards the waist. The front rise seam extends from the crotch and passes through the front torso portion to either the waistband, or the bottom of the fly. It is largely accepted throughout the textile industry that this type of configuration allows the panels to be cut and tailored so that the garment provides a flattering fit, especially in the seat.

These types of garments have conventionally been waterproofed by providing a waterproof outer shell. Alternatively, or in addition to a waterproof outer shell, a waterproof insert attached to the garment inside of the outer layer of the garment can be used, such as disclosed in U.S. Pat. No. RE 33,966 entitled "All Weather Garment" by Robison, filed on Mar. 8, 1990, originally issued Feb. 19, 1991, and re-issued on Jun. 23, 1992. The above-referenced Robison patent explains that moisture penetrates needle holes of the garment's sewn seams, especially in the crotch and along the back rise seam. The Robison patent is directed to a method of sealing sewn seams in the waterproof insert to be watertight.

BRIEF SUMMARY OF THE INVENTION

The invention involves the use of a waterproof seat insert in an outerwear garment. The waterproof seat insert is provided inside of the outer layer of the garment to cover the seat portion of the garment and the rear leg portions which are adjacent to the seat portion. In accordance with the invention, the waterproof insert has a seamless seat and there is no seam in the waterproof insert between the portion of the waterproof insert covering the seat portion and the portion of the waterproof insert covering the rear leg portions which are adjacent to the seat portion. The invention thus eliminates the need to waterproof the back rise seam to provide an effective waterproof seat insert, and also eliminates the possibility of a leak developing through the stitching of the back rise seam.

In an outerwear garment incorporating the invention, the outer textile layer will normally be constructed in the conventional manner, thus enabling appropriate tailoring to provide a flattering fit. That is, the outer textile layer will typically be manufactured from at least four outer layer panels secured together by a continuous inseam, a front rise seam and a back rise seam all intersecting at a crotch of the garment. The outerwear garment will typically include stitched or zippered outseams.

The waterproof seamless seat insert is attached to the garment at the periphery of the waterproof insert so that the insert is substantially free of the seat portion of the outer layer. The waterproof insert is preferably made of stretchable material having a waterproof membrane (e.g. urethane, TEFLON, etc.) applied thereon. The waterproof insert preferably has substantial ease across the seat portion of the garment with respect to the outer textile layer (e.g. two to four inches). If the waterproof insert is made from a relatively lightweight fabric, the existence of the waterproof insert will not be noticeable from the outside of the garment and will not affect the fit of the garment provided by the conventionally constructed outer layer.

The preferred waterproof seamless seat insert is comprised of three panels: a main panel, an upper right thigh panel and an upper left thigh panel. The main panel of waterproof fabric continuously covers the seat and front torso portions, the crotch and the rear leg portions of the garment. The upper right thigh panel of the waterproof insert attaches to the main panel along a right side inseam and an upper front thigh seam which is continuous with the right side inseam. Similarly, the upper left thigh panel attaches to the main panel along a left side inseam and upper front thigh seam which is continuous with the left side inseam. The right side and left side inseams do not intersect each other, thus providing a seamless crotch in addition to the seamless seat and rear leg portions. This construction helps to reduce leakage through the crotch of the garment which can be particularly useful for snowmobilers.

The invention can be used in a variety of insulated and non-insulated garments, most notably pants and coveralls. In garments having an inner liner such as an inner nylon face or an insulated inner layer, the waterproof insert is preferably secured at least in part along its periphery to the inner liner.

It should be noted that the invention is not limited to use in garments having a waterproof or water-resistant outer shell. For instance, many people such as hunters desire the outer layer of the garment to be soft (e.g. fleece) to reduce rubbing noises or for other reasons.

Other features and advantages of the invention may be apparent to those skilled in the art upon inspecting the following drawings and description thereof.

BRIEF DESCRIPTION OF THE DRAWINGS

FIG. 5A is a plan view showing a preferred embodiment of a main panel for the waterproof seamless seat insert made of stretchable waterproof fabric.

FIG. 5B shows upper thigh panels of stretchable waterproof fabric used in the preferred embodiment of the invention to construct the waterproof seamless seat insert.

FIG. 6 is a rear elevational view of the garment shown in FIG. 1 in which the outer layer of the garment has been broken away to illustrate the waterproof seamless seat insert.

FIG. 7 is a detailed view of the various layers of the garment shown in FIG. 6.

FIG. 12 is an elevational view of an exemplary embodiment in accordance with another embodiment of the invention.

FIG. 13 is a schematic view of an alternative manner of constructing a waterproof seamless seat insert in accordance with the invention.

FIG. 14 is a view taken along line 14—14 in FIG. 13.

DETAILED DESCRIPTION OF THE DRAWINGS

Figure 1:
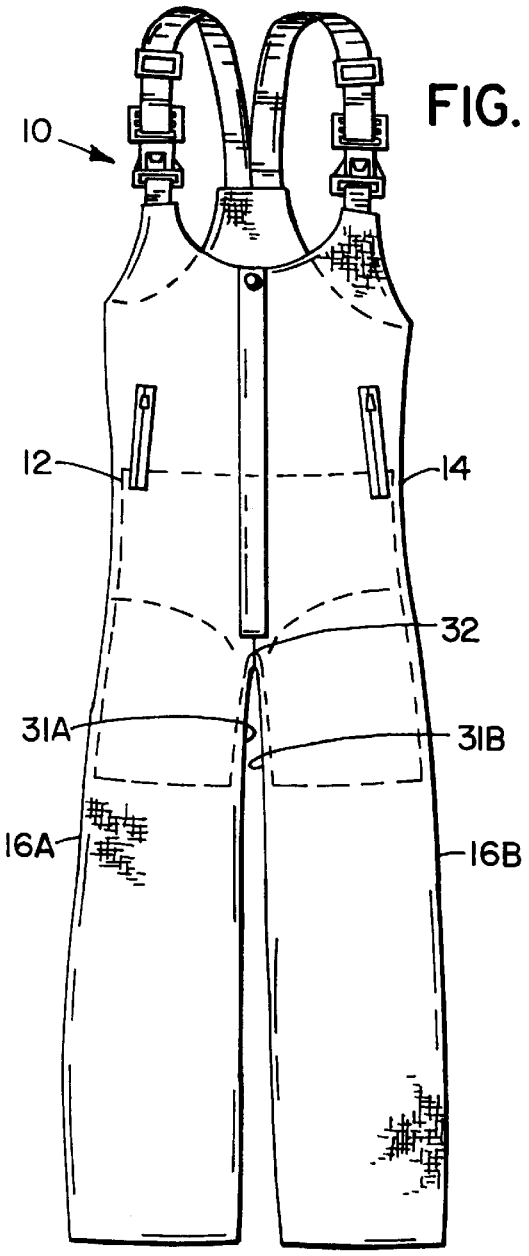
FIG. 1 is an elevational view of an exemplary outerwear garment having a waterproof seamless seat insert in accordance with the invention.

FIGS. 1–8 illustrate an outerwear garment 10 in accordance with a preferred embodiment of the invention. In accordance with the invention, the garment 10 includes a waterproof seamless seat insert 12. Although the invention is shown in the drawings in conjunction with coveralls, the invention can also be used in conjunction with trousers or other similar garments. The garment 10 includes a torso portion 14 and leg portions 16A and 16B. The leg portions 16A, 16B are continuous with the torso portion 14 as is conventional in the art.

Referring in particular to FIGS. 5A and 5B, the waterproof seamless seat insert 12 is constructed from a main panel 18, FIG. 5A, and two upper thigh panels 20A, 20B, FIG. 5B. The panels 18, 20A, 20B are preferably constructed of lightweight fabric onto which a waterproof membrane such as TEFLON or urethane has been applied (e.g. coated or laminated). The main panel 18, FIG. 5A, includes a seat portion 18S, rear upper leg portions 18A, 18B, crotch portion 18C, and front torso portion 18F. In the preferred embodiment of the invention, the entire main panel 18 is seamless. When implementing the invention, it is critical that the entire seat portion 18S of the main panel 18 be substantially seamless, and also that there is no seam in the main panel 18 between the seat portion 18S and the rear upper leg portions 18A, 18B. The front torso portion 18F of the main panel 18 includes a fly slit 18Z, however, a fly slit 18Z is not necessary in the panel 18 if the garment 10 does not include a front fly. Separate front panels for the upper thighs 20A, 20B are shown in FIG. 5B. It is desirable that the panels 18, 20A, 20B be made of a breathable fabric, although this is not necessary to implement the invention. It is also desirable that panels 18A, 20A, 20B be made of a stretchable material such as tricot, and that the panels be cut with sufficient ease especially across the seat portion 18S. For instance, the ease across the seat portion 18S of main panel 18 would preferably be about two to four inches with respect to the other layers of the garment 10 if the main panel 18 is made from a lightweight, waterproof tricot material. If other fabrics are used to construct the main panel 18, it may be desirable to adjust the amount of ease across the seat portion 18S. The amount of preferred ease also depends somewhat on the size of the garment 10.

Figure 2:
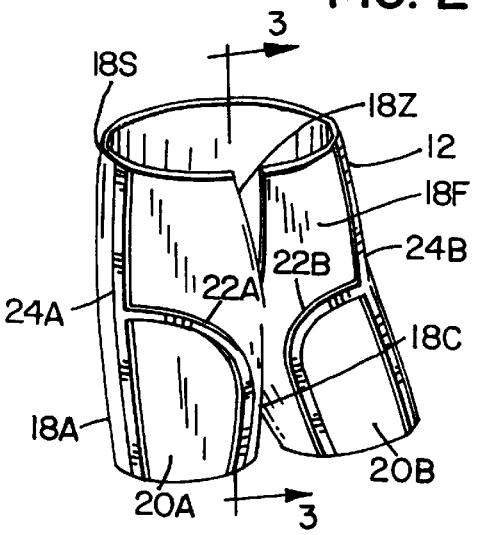
FIG. 2 is a schematic view showing a waterproof seamless seat insert apart from the garment shown in FIG. 1.
Figure 3:
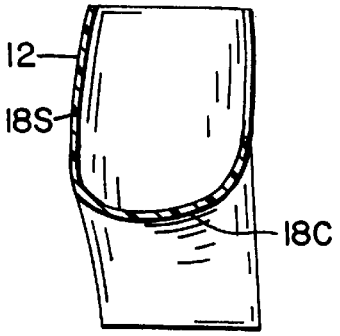
FIG. 3 is a view taken along line 3—3 in FIG. 2.
Figure 4:
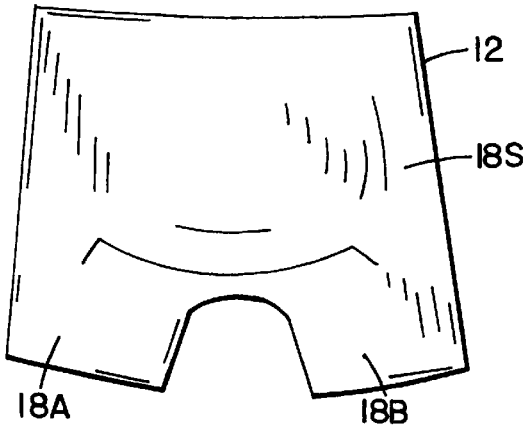
FIG. 4 is a rear elevational view of the waterproof seamless seat insert shown in FIG. 2.
Figure 8:
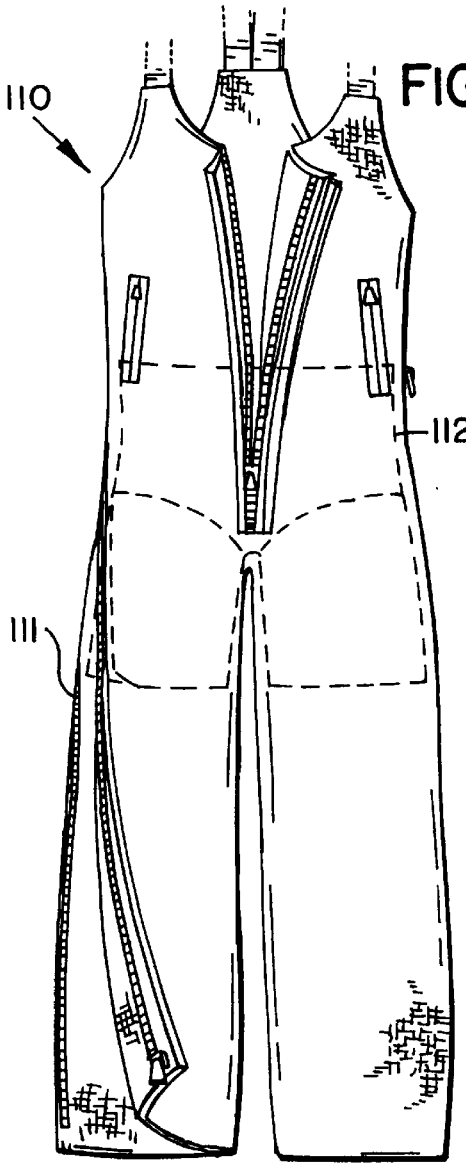
FIG. 8 is a view similar to FIG. 1 showing a garment in which the outseams contain longitudinal zippers.
Figure 9:
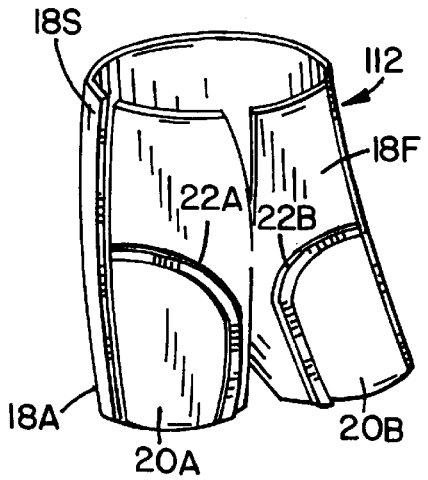
FIG. 9 is a perspective view of the waterproof seamless seat insert used in the garment shown in FIG. 8.

Referring now in particular to FIGS. 2–4, the waterproof seamless seat insert 12 is assembled by stitching the upper thigh panels 20A, 20B to the main panel 18 as shown in FIG. 2. The panels 18, 20A and 20B are sewn or stitched together along the seams 22A, 22B, 24A, 24B. In particular, the upper right thigh panel 20A is stitched to the main panel 18 along a continuous inseam/upper thigh seam 22A. Likewise, the upper left thigh panel 20B is stitched to the main panel 18 along a continuous inseam/upper thigh seam 22B. FIG. 2 also shows outseams 24A and 24B. The lower part of outseam 24A connects the upper right thigh panel 20A to the main panel portion 18A. The upper portion of inseam 24A connects the front torso portion 18F of the main panel 18 to the rear seat portion 18S of the main panel 18. Likewise, the lower portion of outseam 24B connects the front upper thigh panel 20B to the main panel portion 18B. The upper portion of outseam 24B connects the front torso panel 18F to the seat portion 18S of the main panel. In some garments 10, such as shown in FIGS. 8 and 9, the outseams 24A and 24B are replaced with zippers. As illustrated in FIG. 2, it is preferred that the seams 22A, 22B, 24A, 24B be covered with thermally bonded waterproof tape as is conventional in the art to waterproof seams. As shown best in FIGS. 3 and 4, the waterproof seamless seat insert 12 includes no seams across the seat 18S and rear upper leg portions 18A, 18B, FIG. 4, or in the crotch portion 18C.

Referring now to FIGS. 6 and 7, the garment 10 shown in FIGS. 1–7 is an insulated garment which includes several layers of textile material. The garment 10 includes an outer textile layer 26, the seamless seat waterproof insert 12, and an inner lining 28A, 28B. The outer layer 26, and preferably the inner liner 28A, 28B are constructed in the conventional manner to enable appropriate tailoring to provide a flattering fit (e.g. four panels secured together by a continuous inseam 31A, 31B (FIG. 1), a front rise seam 32 (FIG. 1), a back rise seam 34 (in phantom in FIG. 6) all intersecting in the crotch 36 (FIG. 6)). In FIGS. 6 and 7, the outer textile layer 26 is a nylon face, whereas the inner liner 28A, 28B is the combination of an inner nylon face 28A and an insulation layer 28B. It should be noted that the invention is not limited to use on garments 10 having the layer construction shown specifically in FIG. 7.

In FIG. 7, the waterproof fabric 12 has two layers, a lightweight stretchable layer 12A (e.g., tricot) and a waterproof membrane applied thereon 12B. Typical waterproof membranes included a laminated layer of TEFLON or a coated layer of urethane. The waterproof membrane 12B faces the outer layer 26 in FIG. 7, however, it may be desirable for the waterproof membrane 12B to face the inner liner if the waterproof membrane 12B and the outer layer 26 are found to be incompatible. It is possible, in accordance with the invention, to locate the waterproof insert 12 between the lining face 28A and the insulation 28B, or even on the inside surface of the lining 28A, however, it is preferred that the waterproof insert 12 be located adjacent to the outer layer 26.

The waterproof seamless seat insert 12 is attached to the garment 10 along at least a part of the periphery of the waterproof insert so that the insert 12 remains substantially free of the seat portion of the remaining layers of the garment including the outer layer 26 and the liner 28A, 28B. If the garment 10 includes an inner liner 28A, 28B, it is preferred that the waterproof seamless seat insert 12 be attached to the inner liner 28A, 28B as shown in FIG. 6 by stitching along the peripheral edge of the insert 12 illustrated by reference number 30W. If the garment 10 does not include an inner liner 28A, 28B, it is then preferred that the waterproof seamless seat insert 12 be attached to the outer layer 26 along the waist in the location of seam 30W, FIG. 6, and if the garment has zippered outseams along the outseam.

Figure 10:
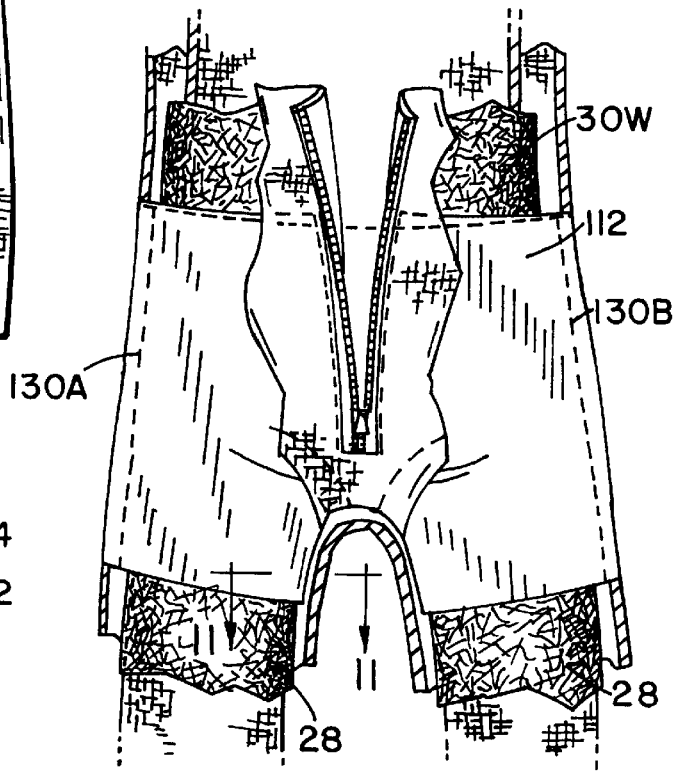
FIG. 10 is a front elevational view of the garment shown in FIG. 8 in which the outer layer of the garment has been removed to illustrate the waterproof insert.

Referring now to the garment 110 shown in FIGS. 8–11, the garment 110 includes a zipper 111 on both legs in lieu of an outseam, although only one of the zippers 111 is shown explicitly in FIG. 8. In the garment 110 shown in FIG. 8, the waterproof seamless seat insert 112 is modified slightly as shown in FIG. 9. In particular, the waterproof seamless seat insert 112 does not include outseams 24A and 24B as shown in FIG. 2, and the panel portions 18S, 19A, 18F, 20A and 20B are not joined together in the location of the outseams 24A and 24B in FIG. 2 when constructing the insert. The insert 112 is attached to the garment 10 along the seam for the zipper 111 as shown in FIG. 10 by stitching 130A, and 130B.

Figure 11:
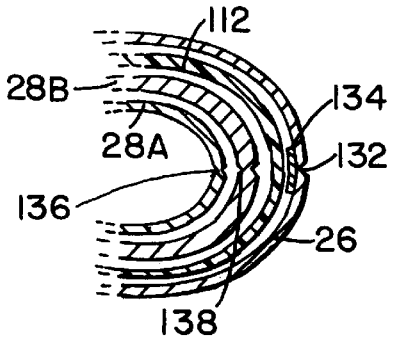
FIG. 11 is a view taken along line 11—11 in FIG. 10.

The view in FIG. 11 shows the various layers 26, 12, 28A, and 28B of the garment 110 along the upper leg inseam area of the garment 110. Note that the outer layer 26 includes an inseam 132 as is conventional in the industry. If desired, thermally bonded waterproof tape 134 can be used to cover the seam 132. The inner liner layers 28A, 28B also include inseams 136, 138 as is conventional in the art. Note, however, that the waterproof insert layer 112 does not include a seam at least at the same location as a conventional inseam 132, 136, 138.

FIG. 12 illustrates a garment 210 in accordance with another embodiment of the invention. The garment 210 has a waterproof insert 212 with enlarged seat and front torso portions 218, and full length legs 220A, 220B. In other respects, the waterproof insert 212 is similar to the inserts 12 or 112 shown in FIGS. 1–10. It may be necessary, however, to incorporate additional seams in the enlarged upper torso portion 218 and/or the enlarged leg portion 220A, 220B in order to cut practical patterns in fabric.

FIGS. 13 and 14 show yet another embodiment of the invention in which a waterproof seamless seat insert 312 is provided with a main panel 318, but no upper thigh panels 20A, 20B. A garment incorporating the waterproof insert 312 would typically be less expensive to fabricate than a comparable garment including the inserts 12, 112 or 212 shown in FIGS. 1–12. The seamless seat insert 312 includes a seamless seat 318S, rear upper leg portions 318A, 318B, and optionally, a crotch portion 318C. It may be desirable to provide crotch portion 318C for the waterproof insert 312, or alternatively it may be desirable to stitch the lower part of the waterproof insert 312 directly into the inseam for the garment 310. Such a waterproof insert 312 may be desirable for certain garments, such as those typically used by hunters.

The invention has been described herein with respect to several exemplary embodiments. Certainly, those skilled in the art may be able to implement the invention in other types of garments or in modified configurations without departing from the true spirit of the invention. Such alternatives and modifications should be considered to fall within the scope of the following claims.

We claim:

1. An outerwear garment having a waterproof seat comprising:

an outer textile layer having continuous leg and torso portions for the garment, the torso portion including a seat portion and a front portion; and a waterproof insert attached to the garment inside of the outer textile layer to cover the seat portion of the outer layer, rear leg portions of the outer layer which are adjacent to the seat portion and a crotch portion of the outer layer, the waterproof insert being made of waterproof fabric and having a seamless seat, there being no seam in the waterproof insert between the portion of the waterproof insert covering the seat portion of the outer layer and the portion of the waterproof insert covering the crotch portion of the outer layer, there also being no seam in the waterproof insert between the portion of the waterproof insert covering the seat portion of the outer layer and the portion of the waterproof insert covering the adjacent rear leg portions of the outer layer, wherein the waterproof seamless seat insert is substantially free of the seat portion of the outer layer and is attached to the garment along at least a part of the periphery of the waterproof insert.

2. An outerwear garment having a waterproof seat as recited in claim 1 wherein the outer textile layer includes at least four panels secured together by a continuous inseam, a front rise seam and a back rise seam, all intersecting at a crotch of the garment, the back rise seam extending from the crotch and passing through at least part of the seat portion of the outer layer, the front rise seam extending from the crotch and passing through at least part of the front torso portion of the outer layer, and the inseam extending from the crotch through the leg portions of the outer layer.

3. An outerwear garment having a waterproof seat as recited in claim 2 wherein the waterproof insert comprises a main panel of waterproof fabric that continuously covers the seat portion and the rear leg portions adjacent the seat portion of the garment, and a part of the periphery of the waterproof insert is stitched into the continuous inseam of the outer textile layer.

4. An outerwear garment having a waterproof seat as recited in claim 1 further comprising an inner textile layer attached to the outer textile layer with the waterproof insert therebetween.

5. An outerwear garment having a waterproof seat as recited in claim 4 wherein the inner textile layer is made from an insulating textile material.

6. An outerwear garment having a waterproof seat as recited in claim 4 wherein the waterproof insert is attached to the garment by attaching the waterproof insert at least in part to the inner textile layer.

7. An outerwear garment having a waterproof seat as recited in claim 1 wherein the garment includes zippered outseams and a part of the periphery of the waterproof insert is stitched into each of the zippered outseams.

8. An outerwear garment having a waterproof seat as recited in claim 1 wherein the waterproof insert is made from a lightweight, waterproof fabric.

9. An outerwear garment having a waterproof seat as recited in claim 1 wherein the waterproof insert is made from a stretchable fabric with a waterproofing membrane applied thereon.

10. An outerwear garment having a waterproof seat as recited in claim 9 wherein the waterproof membrane on the stretchable fabric faces the outer textile layer.

11. An outerwear garment having a waterproof seat as recited in claim 9 wherein the waterproof membrane on the stretchable fabric faces away from the outer textile layer.

12. An outerwear garment having a waterproof seat as recited in claim 1 wherein the outer textile layer is made from one or more of the textile materials in the group of textile materials consisting of waterproofed textile fabric, water-resistant textile fabric and fleece.

13. An outerwear garment having a waterproof seat comprising:

an outer textile layer having continuous leg and torso portions for the garment, the torso portion including a seat portion and a front portion; and a waterproof insert attached to the garment inside of the outer textile layer to cover the seat portion of the outer layer and rear leg portions of the outer layer which are adjacent to the seat portion, the waterproof insert being made of waterproof fabric and having a seamless seat, there also being no seam in the waterproof insert between the portion of the waterproof insert covering the seat portion of the outer layer and the portion of the waterproof insert covering the adjacent rear leg portions of the outer layer, wherein the waterproof seamless seat insert is substantially free of the seat portion of the outer layer, is attached to the garment along at least a part of the periphery of the waterproof insert, and comprises:

a main panel of waterproof fabric that continuously covers the seat portion, the front torso portion, the crotch and the rear leg portions adjacent the seat portion of the garment.

14. An outerwear garment having a waterproof seat as recited in claim 13 wherein the waterproof insert further comprises:

an upper right thigh panel of waterproof fabric that is attached to the main panel of waterproof fabric along a right side continuous inseam/upper front thigh seam; and an upper left thigh panel of waterproof fabric that is attached to the main panel of waterproof fabric along a left side continuous inseam/upper front thigh seam;

wherein the right side and left side continuous inseam/upper front thigh seams do not intersect one another.

15. An outerwear garment having a waterproof seat comprising:

an outer textile layer having continuous leg and torso portions for the garment, the torso portion including a seat portion and a front portion; and a waterproof insert attached to the garment inside of the outer textile layer to cover the seat portion of the outer layer and rear leg portions of the outer layer which are adjacent to the seat portion, the waterproof insert being made of waterproof fabric and having a seamless seat, there also being no seam in the waterproof insert between the portion of the waterproof insert covering the seat portion of the outer layer and the portion of the waterproof insert covering the adjacent rear leg portions of the outer layer, wherein the waterproof seamless seat insert is substantially free of the seat portion of the outer layer, is attached to the garment along at least a part of the periphery of the waterproof insert, and there is substantial ease across the seamless seat of the waterproof insert with respect to the seat portion of the outer textile layer such that a distance measurement taken across the seat between attachment locations for the waterproof insert to the garment is greater when taken along a path on the seamless seat of the waterproof inset than when taken along a corresponding path on the seat portion of the outer textile layer.

16. An outerwear garment having a waterproof seat as recited in claim 15 wherein the outer textile layer includes at least four panels secured together by a continuous inseam, a front rise seam and a back rise seam, all intersecting at a crotch of the garment, the back rise seam extending from the crotch and passing through at least part of the seat portion of the outer layer, the front rise seam extending from the crotch and passing through at least part of the front torso portion of the outer layer, and the seam extending from the crotch through the leg portions of the outer layer.

17. An outerwear garment having a waterproof seat comprising:

an outer textile layer having continuous leg and torso portions for the garment, the torso portion including a seat portion and a front portion; and a waterproof insert attached to the garment inside of the outer textile layer to cover the seat portion of the outer layer and rear leg portions of the outer layer which are adjacent to the seat portion, the waterproof insert being made of waterproof fabric and having a seamless seat, there also being no seam in the waterproof insert between the portion of the waterproof insert covering the seat portion of the outer layer and the portion of the waterproof insert covering the adjacent rear leg portions of the outer layer, wherein:

the waterproof seamless seat insert is substantially free of the seat portion of the outer layer, is attached to the garment along at least a part of the periphery of the waterproof insert the outer textile layer includes at least four panels secured together by a continuous inseam, a front rise seam and a back rise seam, all intersecting at a crotch of the garment, the back rise seam extending from the crotch and passing through at least part of the seat portion of the outer layer, the front rise seam extending from the crotch and passing through at least part of the front torso portion of the outer layer, and the inseam extending from the crotch through the leg portions of the outer layer, and the seams on the outer textile layer are stitched and covered with thermal bonding waterproof tape on the inside surface of the outer textile layer.

18. An outerwear garment having a waterproof seat comprising:

an outer textile layer having continuous leg and torso portions for the garment, the torso portion including a seat portion and a front portion; and a waterproof insert attached to the garment inside of the outer textile layer to cover the seat portion of the outer layer and rear leg portions of the outer layer which are adjacent to the seat portion, the waterproof insert being made of waterproof fabric and having a seamless seat, there also being no seam in the waterproof insert between the portion of the waterproof insert covering the seat portion of the outer layer and the portion of the waterproof insert covering the adjacent rear leg portions of the outer layer, wherein the waterproof seamless seat insert is substantially free of the seat portion of the outer layer and is attached to the garment along at least a part of the periphery of the waterproof insert; and wherein the garment includes a fly in the front torso portion and the waterproof insert includes a fly slit to accomodate the fly in the front torso portion.

* * * * *